US007343921B2

(12) United States Patent
Salinas

(10) Patent No.: US 7,343,921 B2
(45) Date of Patent: Mar. 18, 2008

(54) HAIR EXTENSION

(76) Inventor: Hortencia Salinas, 8342 E. Norfolk Ave., Orange, CA (US) 92867

( * ) Notice: Subject to any disclaimer, the term of this patent is extended or adjusted under 35 U.S.C. 154(b) by 117 days.

(21) Appl. No.: 11/256,873

(22) Filed: Oct. 24, 2005

(65) Prior Publication Data

US 2006/0086368 A1 Apr. 27, 2006

Related U.S. Application Data

(63) Continuation-in-part of application No. 11/117,192, filed on Apr. 28, 2005, now abandoned, which is a continuation-in-part of application No. 10/847,703, filed on May 17, 2004, now abandoned.

(51) Int. Cl.
*A41G 3/00* (2006.01)

(52) U.S. Cl. ..... 132/201; 132/53

(58) Field of Classification Search ..... 132/201, 132/53–56

See application file for complete search history.

(56) References Cited

U.S. PATENT DOCUMENTS

| | | | | |
|---|---|---|---|---|
| 376,444 | A | 1/1888 | Mann | |
| 3,280,826 | A | 10/1966 | Jenkins | |
| 3,470,889 | A | 10/1969 | Webb | |
| 3,612,071 | A | 10/1971 | Holly | |
| 3,651,820 | A | 3/1972 | Johnson et al. | |
| 3,662,766 | A | 5/1972 | Maassen et al. | |
| 3,809,099 | A | 5/1974 | Goldberg et al. | |
| 4,254,784 | A | 3/1981 | Nelson | |
| 4,296,765 | A | 10/1981 | Bachtell et al. | |
| 4,453,555 | A * | 6/1984 | Finamore | 132/53 |
| 4,509,539 | A | 4/1985 | Alfieri | |
| 4,516,189 | A | 5/1985 | Seaks, Jr. | |
| 4,517,999 | A | 5/1985 | Finamore | |
| 4,934,387 | A | 6/1990 | Megna | |
| 4,966,173 | A | 10/1990 | Russell | |
| 5,072,745 | A | 12/1991 | Cheh | |
| 5,107,867 | A | 4/1992 | Barrington | |

(Continued)

FOREIGN PATENT DOCUMENTS

DE 2440709 A1 3/1976

(Continued)

OTHER PUBLICATIONS

Wig JA 10-292216 Matsurmura Translation.*

(Continued)

*Primary Examiner*—Robyn Doan
*Assistant Examiner*—Rachel A. Running
(74) *Attorney, Agent, or Firm*—Dobrusin & Thennisch PC

(57) ABSTRACT

The present invention provides a hair extension apparatus and kit and method of making and using such hair extension apparatus. The hair extension apparatus include an anchor band constructed of a flexible material having a frontal outer surface, a rear inner surface and mounting holes for accepting a portion of primary hairs and a plurality of supplementary hairs permanently engaged with the anchor band and extended away from the frontal outer surface so as to drape downwardly. The hair extension apparatus may optionally comprise attachment means to be used in conjunction with the portion of primary hairs to form a secured attachment between the anchor band and the user's head.

8 Claims, 10 Drawing Sheets

U.S. PATENT DOCUMENTS

| | | | | |
|---|---|---|---|---|
| 5,121,761 | A | 6/1992 | Meister | |
| 5,313,963 | A | 5/1994 | Rennex | |
| 5,357,986 | A * | 10/1994 | Hargrett | 132/201 |
| 5,575,298 | A | 11/1996 | Hinton | |
| 5,647,384 | A | 7/1997 | Haber et al. | |
| 5,722,434 | A | 3/1998 | Walker | |
| 5,752,530 | A | 5/1998 | Traintinger | |
| 5,813,418 | A | 9/1998 | Pillars | |
| 5,868,145 | A | 2/1999 | Spann | |
| 5,881,737 | A | 3/1999 | Nelson | |
| 6,109,274 | A | 8/2000 | Ingersoll | |
| 6,276,368 | B1 * | 8/2001 | Giamalva | 132/201 |
| 6,405,736 | B2 * | 6/2002 | Townsend | 132/201 |
| 6,446,636 | B1 * | 9/2002 | Vittallo | 132/201 |
| 6,494,212 | B1 | 12/2002 | Yamakoshi | |
| 6,584,983 | B1 * | 7/2003 | Nicot et al. | 132/53 |
| 6,688,315 | B1 | 2/2004 | Harrison | |
| 6,832,614 | B2 | 12/2004 | Frazier | |
| 6,837,249 | B2 | 1/2005 | Smith | |
| 2003/0140934 | A1 | 7/2003 | Sugai et al. | |
| 2003/0234027 | A1 | 12/2003 | Smith | |
| 2004/0149301 | A1 * | 8/2004 | Arroyo et al | 132/201 |
| 2004/0168699 | A1 * | 9/2004 | Park | 132/201 |
| 2005/0061346 | A1 | 3/2005 | Song | |
| 2005/0081873 | A1 * | 4/2005 | Chung | 132/201 |

FOREIGN PATENT DOCUMENTS

| | | | |
|---|---|---|---|
| DE | 331349 | A1 | 10/1984 |
| GB | 1 341 576 | | 12/1973 |
| JP | 410077512 | A | 3/1998 |
| JP | 410077513 | A | 3/1998 |
| JP | 410292216 | A | 11/1998 |
| NL | 1 022 306 | C1 | 7/2004 |
| WO | WO 2005/044031 | | 5/2005 |

OTHER PUBLICATIONS

International Search Report dated Aug. 10, 2005. PCT/US05/014602. (1268.001wo).

* cited by examiner

HAIR EXTENSION

PRIORITY CLAIM

This application claims the benefit of U.S. application Ser. No. 10/847,703 titled: "Hair Extension and Method of Use" filed on May 17, 2004 and U.S. application Ser. No. 11/117,192 titled: "Hair Extension" filed on Apr. 28, 2005.

INCORPORATION BY REFERENCE

Applicant hereby incorporates by reference any and all U.S. patents and U.S. patent applications cited or referred to in this application.

FIELD OF INVENTION

This invention related generally to hairpieces and particularly to a novel apparatus, kit, method of use, and method of making hair extension.

BACKGROUND OF INVENTION

Hair replacement, i.e., the use of a hairpiece or wig to cover up an area of baldness on an individual's head is well known and many patents have been issued for hair replacement. Below are examples of such patents.

Buckwalter, U.S. Des. 376,444 describes a design for a supplemental hairpiece.

Jenkins, U.S. Pat. No. 3,280,826 describes a method of making a hair piece adapted to be secured to the live hair on the head comprising, folding a weft having a base portion and commercial hair secured thereto a predetermined number of times with said folded base portions forming a foundation, providing fastener means having a plurality of apertures there through, placing said fastener means against said folded base portions, and securing said adjacent folds of said weft together by passing stitches through the apertures in said fastener means and through the foundation formed by said folded base portion to secure said portions in folded relationship.

Johnson et al., U.S. Pat. No. 3,651,820 describes a method for holding a hairpiece firmly in place on a wearer's head by anchoring adjustable brackets to the wear's existing hair. A firm anchor is formed from a bead of melted rubber, which is fused into a thin strip of existing hair, and subsequently hardens therein. An anchor attachment and adjustable male bracket engaging a corresponding female bracket attached to the base of the hairpiece to firmly hold the hairpiece in place. The effective length of the male bracket may be adjusted to compensate for hair growth over a period of time.

Maassen et al., U.S. Pat. No. 3,662,766 describes a hairpiece, which is anchored with the surrounding natural hair. The hairpiece has plurality of locking devices attached to its base. The locking devices have a first section, which is attached to the hairpiece, and a second section, which is adapted to being lockingly engaged with the first section. The second is attached to the natural hair by means, which permits adjustment of the attachment between the natural hair and the second section to compensate for growth of the natural hair.

Nelson, U.S. Pat. No. 4,254,784 describes an improved hair unit assembly and method wherein the user's natural hair is employed to attach the hair unit in place. In practice, one or more elongated, apertured tubes are placed adjacent the user's natural hair, and strands thereof are pulled into the tubes; an elongated, frictional locking member or adhesive is then inserted with each tube to secure the tubes in place. An appropriate hair unit can then be secured to the tubes by any one of a number of techniques. Reinforcing tube segments are also used to interconnect and bridge spaced hair-receiving tube sections to this rigidify the overall assembly.

Russell, U.S. Pat. No. 4,966,173 describes a hairpiece for covering areas of partial hair loss removal or thinning on a user's head is disclosed. The hairpiece includes a band of resilient material in an arcuate shape, which hair is attached. When worn, the foundation of hair is positioned over the area of hair loss or removal to conceal the area, and the user's own hair may be combed or styled in a fashion to incorporate the hair of the hairpiece with that of the user to produce a natural look.

Rennex, U.S. Pat. No. 5,313,963 describes an improved hairpiece base comprising a mesh and mesh binder. The mesh affords structural strength in the lateral plane, and it serves as an anchor for artificial hairs. The mesh minder fills the region between the mesh strands, and its thickness is approximately equal to the diameter of the mesh strands. At the perimeter of the base, the mesh binder edge may be tapered in thickness.

Walker, U.S. Pat. No. 5,722,434 describes a hair enhancement system including a female portion having a first flexible fabric strip having a first plurality of female snap fastener halves secured to and evenly spaced a first spacing distance along a first side surface thereof; a male portion having a second flexible fabric strip having a second plurality of male snap fastener halves that are mateably with the female snap fastener halves of the female portion secured to evenly spaced by the first spacing distance along a second side surface thereof; and a hair enhancement weft including a third plurality of flexible enhancement hair strands secured to and extending from a side edge of one of said female and male portions along the length thereof. The hair enhancement system is utilized by placing a section of hair from the person having the hair enhancements applied between the female or male portions and snapping the female snap fastener strip to the male snap fastener strip in a manner to retain the section of hair from the person there between.

The hair replacement prior art discussed above serves the need of covering baldness with hair. To achieve this purpose, the hair replacement apparatus (commonly known as wig, toupee, rug, etc.) is placed on the surface of the bald area leaving most, if not all, of the apparatus visible to others. However, the hair replacement prior art does not address the need of individuals who do not suffer from hair loss but instead want to extend the apparent length or design to their existing hair (hereinafter known as primary hair).

Hair extension addresses this need and has become popular during the last few years. Extensions have been profiled at trade shows during the last five years with popularity growing over the last three years. Celebrities have been known to use hair extension to change the length and/or style of their primary hair so they can show up in one event in short hair and another event within days in long hair. Hair extension that looks and feels natural (e.g., seamless among the user's primary hair) is highly prized. Conventional hair extension requires attachment (e.g., gluing or the like) of individual strand of supplemental hair to individual strand of primary hair. This process is labor intensive requiring long hours of application by a skilled professional and therefore, substantial costs. The process can cost thousands of dollars. Furthermore, the user is usually required to undergo this long and expensive process periodically as the attachment between the individual strand of supplemental hair to individual strand of primary hair fails. Accordingly, there exists a need to provide hair extension that looks natural without long hours of application by a skilled professional.

Additionally, removal of the conventional hair extension generally requires damage and/or change to the primary hair (e.g., cutting),which may not be desired. Accordingly, there is a need to provide hair extension that can be removed without changing the primary hair. There is also a need to provide hair extension that is reusable (i.e., can be re-applied).

SUMMARY OF THE INVENTION

The present invention fulfills these needs by providing a hair extension apparatus and method that provides simple and quick attachment of supplemental hairs to the user's primary hairs. The present invention provides hair extension that is high quality in appearance (e.g., natural looking) without the high costs and the long hours of application. The present invention provides hair extension that can be easily removed and/or reapplied without change to the primary hair. The present invention also provides further related advantages as described herein.

The present invention provides a method for attaching a hair extension apparatus to primary hairs (e.g., a person's pre-existing natural or artificial hairs) on a user's head. The hair extension can extend the apparent length, provide added fullness, texture and/or design to the primary hairs. This hair extension may also enhance the healthy appearance of the primary hair or provide a healthy appearance to damaged primary hair. The hair extension may make the primary hair more manageable by introducing texture to the primary hair.

The method is comprised of: (1) providing a hair extension apparatus comprising an anchor band constructed of a flexible material having a frontal outer surface, a rear inner surface and mounting holes for accepting a portion of primary hairs and a plurality of supplementary hairs permanently engaged with the anchor band and extend away from the frontal outer surface so as to drape downwardly; (2) placing the anchor band against a user's scalp in a location having primary hairs and wherein the anchor band will be hidden by additional primary hairs located above and around the anchor band; (3) feeding a portion of the primary hairs under the anchor band through the mounting holes in the anchor band; (4) attaching the portion of the primary hairs extending from at least two of the mounting holes together via attachment means so as to form a secured attachment between the anchor band and the user's scalp without use of adhesive.

The present invention also provides a method of hair extension comprising (1) placing a hair extension apparatus against a user's scalp wherein the hair extension apparatus is comprised of an anchor band constructed of a flexible material having a frontal outer surface, a rear inner surface and mounting holes for accepting a portion of primary hairs and a plurality of supplementary hairs permanently engaged with the anchor band and extend away from the frontal outer surface so as to drape downwardly; (2) feeding a portion of the primary hairs through the mounting holes in the anchor band; (3) attaching the portion of the primary hairs extending from at least two of the mounting holes together via attachment means so as to form a secured attachment between the anchor band and the user's scalp.

The present invention further provides a hair extension apparatus comprising an anchor band constructed of a flexible material having a frontal outer surface, a rear inner surface and mounting holes for accepting a portion of primary hairs; a plurality of supplementary hairs permanently engaged with the anchor band and extend away from the frontal outer surface so as to drape downwardly; wherein the anchor band is placed against a user's scalp in a location having primary hairs and is hidden by additional primary hairs located above and around the anchor band.

The present invention also provides a hair extension apparatus comprising an anchor band of a flexible material having frontal outer surface and a rear inner surface and a plurality of mounting holes for accepting primary hairs, wherein the mounting holes are arranged in at least two parallel rows of linear arrays across the anchor band and all of the mounting holes within the anchor band are about 10 mm to 20 mm apart; a plurality of supplementary hairs permanently engaged with the anchor band and extending out of and away from the frontal outer surface so as to drape downwardly; and a plurality of tubular ferrules, each engaged with a portion of the primary hairs extended out of the anchor band from at least two adjacent the mounting holes forming a secured attachment of the anchor band to a user's scalp without use of adhesive; wherein the secured attachment of the anchor band to the user's scalp is located in a location of the user's scalp having the primary hairs and that allows the anchor band to be hidden by additional primary hairs located above and around the anchor band.

The present invention further provides a hair extension apparatus comprising an anchor band constructed of a flexible material having a frontal outer surface, a rear inner surface and mounting holes for accepting a portion of primary hairs of a user's scalp; a plurality of supplementary hairs permanently engaged with the anchor band and extend away from the frontal outer surface so as to drape downwardly. The hair extension apparatus may optionally comprise attachment means for forming a secured attachment between the anchor band and the user's head.

The present invention further provides a method of making a hair extension apparatus comprising: providing an anchor band having a frontal outer surface, a rear inner surface and mounting holes for accepting a portion of primary hairs; attaching supplementary hairs to the anchor band so that the supplementary hairs are extended away from the frontal outer surface and draped downwardly.

The present invention also provides a hair extension kit comprising at least one of the above-described hair extension apparatus; at least one item selected from the group consisting of pliers, combs, brushes, needle holders, adhesive tapes, attachment means (e.g., ferrules, clamps, or the like), hair swatches, instructions for use, hair decorative accessories, and a combination thereof; and a container for holding the at least one hair extension apparatus and the at least one item.

An objective of the present invention is to assure that an embodiment of the invention is capable of being quickly attached in place.

A further objective is to assure that an embodiment of the invention is capable of being quickly retightened against the user's scalp when necessary.

A still further objective is to assure that an embodiment of the invention is capable of being made thin enough to be fully covered by the primary hairs when place next to the user's scalp.

Another objective is to avoid damage or change to the user's primary hair upon removal and/or reapplication of the hair extension.

A further objective is to provide a hair extension apparatus that is re-usable or can be reapplied.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above-described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

The Hair Extension Apparatus

Figure 3:
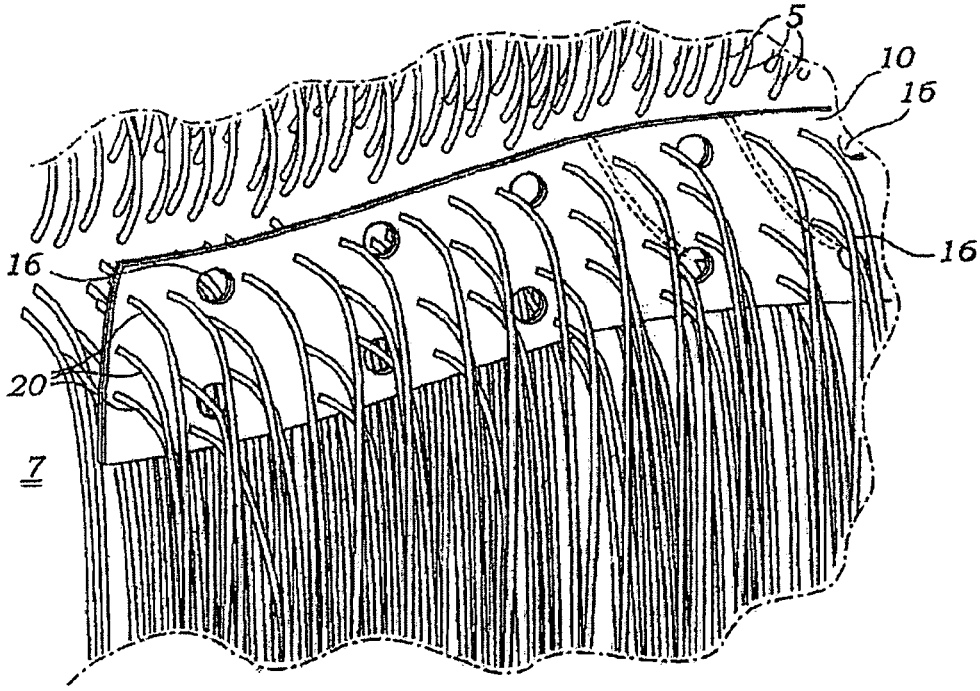
FIG. 3 is a perspective view of the hair extension apparatus shown in FIG. 1 against a user's scalp.
Figure 4:
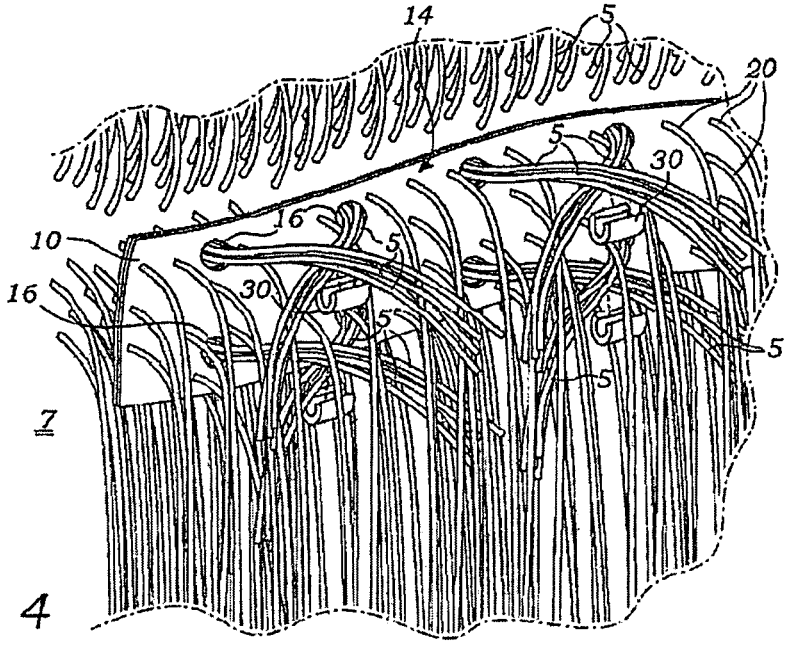
FIG. 4 is a perspective view of the hair extension apparatus shown in FIG. 1 with primary hairs of a user through the anchor band's mounting holes.
Figure 5:
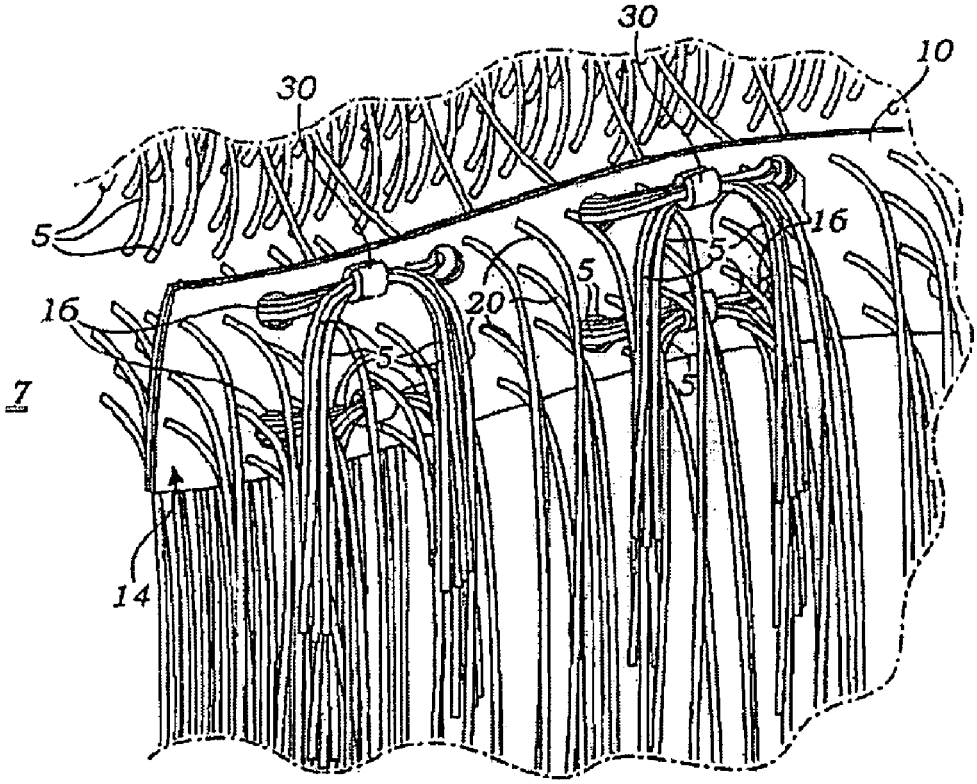
FIG. 5 is a perspective view of the hair extension apparatus shown in FIG. 1 with attachment means (e.g., ferrules) used to secure the anchor band to the user's scalp.
Figure 6:
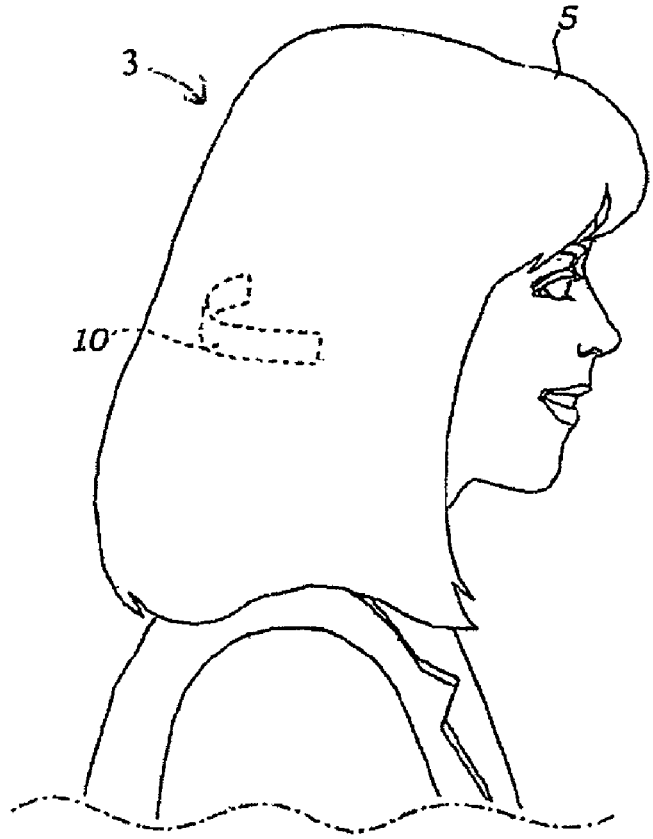
FIG. 6 is a side elevational view of a user wearing the hair extension apparatus shown in FIG. 1 with hidden lines showing one possible placement of the anchor band.

Referring to FIGS. 1-6, a preferred embodiment 100 of the present invention of a hair extension apparatus is described. Referring to FIGS. 5-6, the term "primary hairs" (5) is used herein to refer to the existing (living and/or artificial) hairs on a user's head 3 and it is noted that these primary hairs 5 may continue to grow outwardly from the user's scalp 7 over time. The apparatus 100 is used to extend the apparent length of, and/or provide added fullness and/or texture to, the primary hairs 5.

Figure 1:
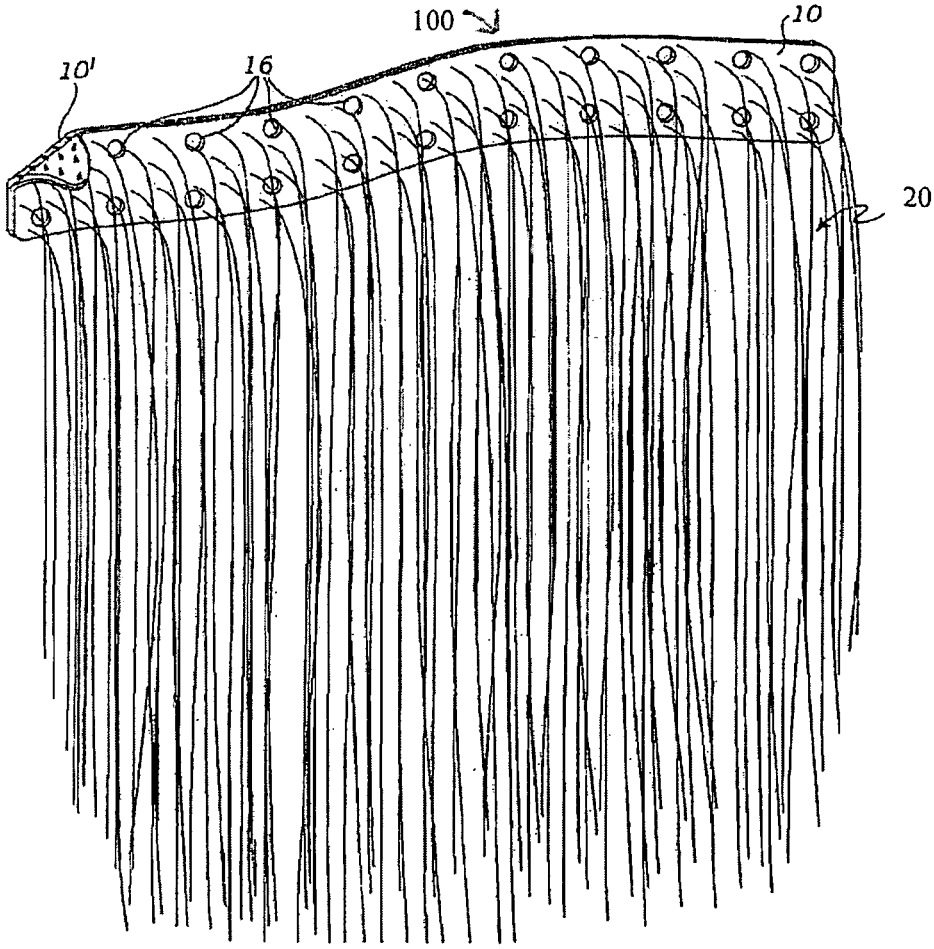
FIG. 1 is a perspective view of an exemplary embodiment of a hair extension apparatus of the present invention showing supplementary hairs draped downwardly.
Figure 2:
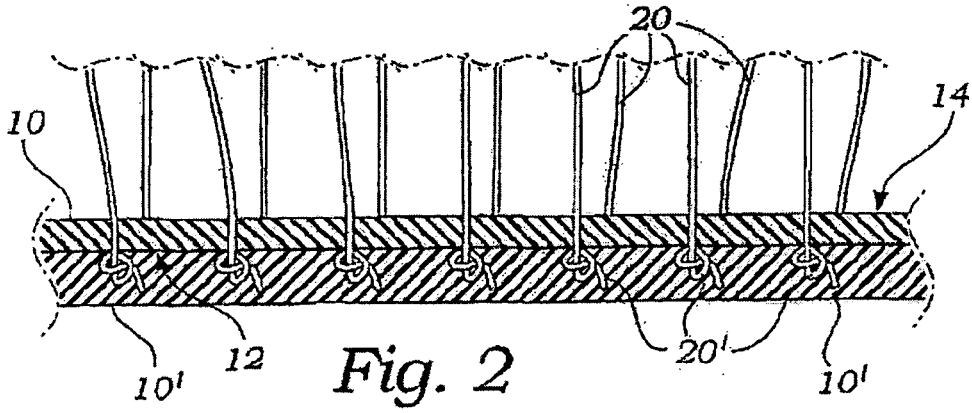
FIG. 2 is a partial cross section of the anchor band of the hair extension apparatus shown in FIG. 1.

Referring to FIGS. 1-2, the apparatus 100 includes an anchor band 10 having a rear inner surface 12 and a frontal outer surface 14. A plurality of supplementary hairs 20 are permanently engaged with the anchor band 10 using any art-disclosed methods. For example, the plurality of supplementary hairs 20 can be permanently engaged with the anchor band 10 by being pressed through the anchor band 10 and knotted on the rear inner surface 12 as shown in FIG. 2. It is preferred that a layer of coating 10' is used to coat the rear inner surface 12 of the anchor band 10 so as to assure that the knots 20' formed in the supplementary hairs 20 cannot unravel. The layer of coating 10' can be constructed of any art-disclosed suitable material such as lacquer, silicone, other polymer or the like.

The supplementary hairs 20 are preferably extend out of and away from the frontal outer surface 14 so as to drape downwardly as shown in FIG. 1. The term "supplementary hairs" (20) is used herein to refer to hairs (natural or synthetic) that are made a part of the apparatus 100. The supplementary hairs 20 can be in any desired color(s) and constructed or styled in any art-disclosed fashion such as straight, wavy, curly, braided, or a combination thereof. These supplemental hairs 20 do not grow outwardly from the anchor band 10 to which they are attached. Wigs use a diversity of different knotting techniques in order to create hair direction (height, part, direction of the crown). The method of attaching the supplementary hairs to the anchor band is called ventilation (the art of attaching hair using knots). Ventilation determines the direction of the supplementary hairs. Unlike wigs and other hair replacement apparatus, which usually requires height, part, and/or direction of crown, the hair extension of the present invention primarily uses single, double, triple or quadruple FLAT knots. Flat knots position the supplementary hairs to lie flat against the anchor band and to extend out and away from the frontal outer surface in order to drape downwardly.

Referring to FIGS. 3-4, the anchor band 10 is placed against the scalp 7 and provides a plurality of mounting holes 16 for accepting a portion of the primary hairs 5 extending from the rear inner surface 12 to the frontal outer surface 14. Unlike an hair replacement apparatus which is placed in an area without primary hairs, the anchor band 10 is placed in an area of the scalp 7 that having primary hairs 5 thereby allowing each of the mounting holes 16 to be in locations where primary hairs 5 can be fed through. Also dissimilar to an hair replacement apparatus which is usually entirely visible to others, the anchor band 10 should also be located in an area of the scalp 7 that allow it to be hidden or fully covered by additional primary hairs 5 located above and around the anchor band 10. During the application process, these additional primary hairs 5 located above and around the anchor band 10 are preferably moved away from area near and around the anchor band 10 in order to facilitate ease of application. However, upon completion of the application, these additional primary hairs 5 are placed back into their original positions providing full coverage of the anchor band 10.

The anchor band 10 can be constructed of any art-disclosed flexible material such as fabric, silicone, plastic, other polymer, or a combination thereof. The flexible material can be any thickness suitable for the desired application. In a preferred embodiment, the anchor band 10 is constructed of a composite material comprising a layer of fabric (e.g., silk or the like) sandwiched between two layers of polyurethane. In another preferred embodiment, the anchor band 10 is comprised of a layer of polyurethane, a layer of fabric (e.g., silk or the like), another layer of polyurethane (preferably thicker than the first layer of polyurethane by a ratio of at least 2 to 4), supplementary hairs 20 attached to these layers of the anchor band 10 with FLAT knots, and a final layer of polyurethane. The total thickness of this preferred embodiment is about 0.5 mm to about 1.5 mm, more preferably about 1 mm.

Figure 7:
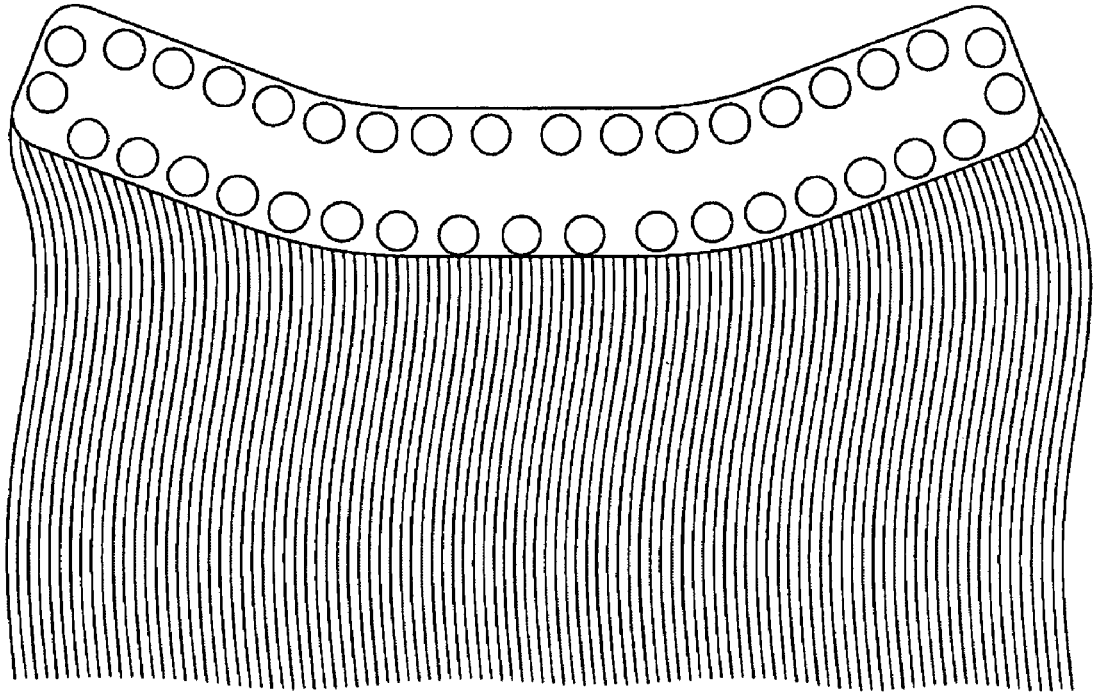
FIG. 7 is a perspective view of another exemplary embodiment of the hair extension apparatus of the present invention.
Figure 8:
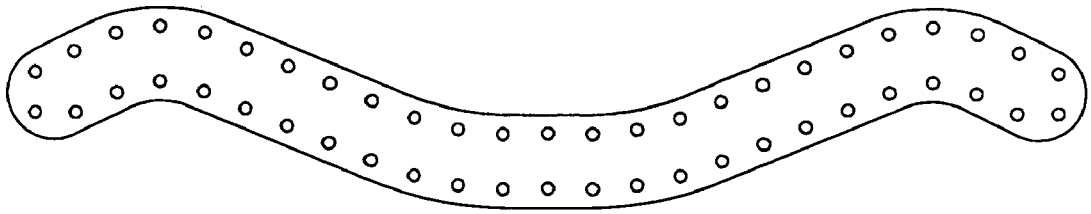
FIG. 8 is a perspective view of an exemplary embodiment of the anchor band of the present invention.
Figure 9:
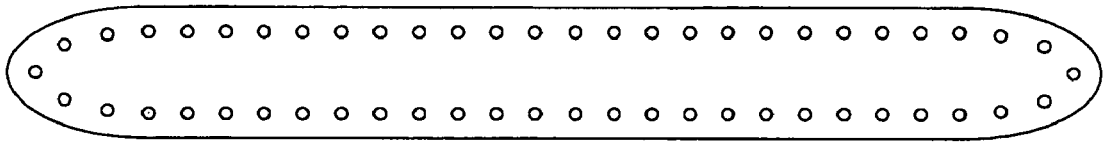
FIG. 9 is a perspective view of another exemplary embodiment of the anchor band of the present invention.
Figure 10:
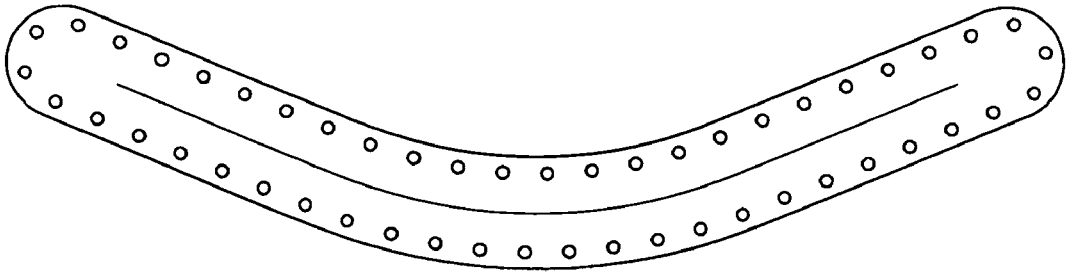
FIG. 10 is a perspective view of yet another exemplary embodiment of the anchor band of the present invention.
Figure 11:
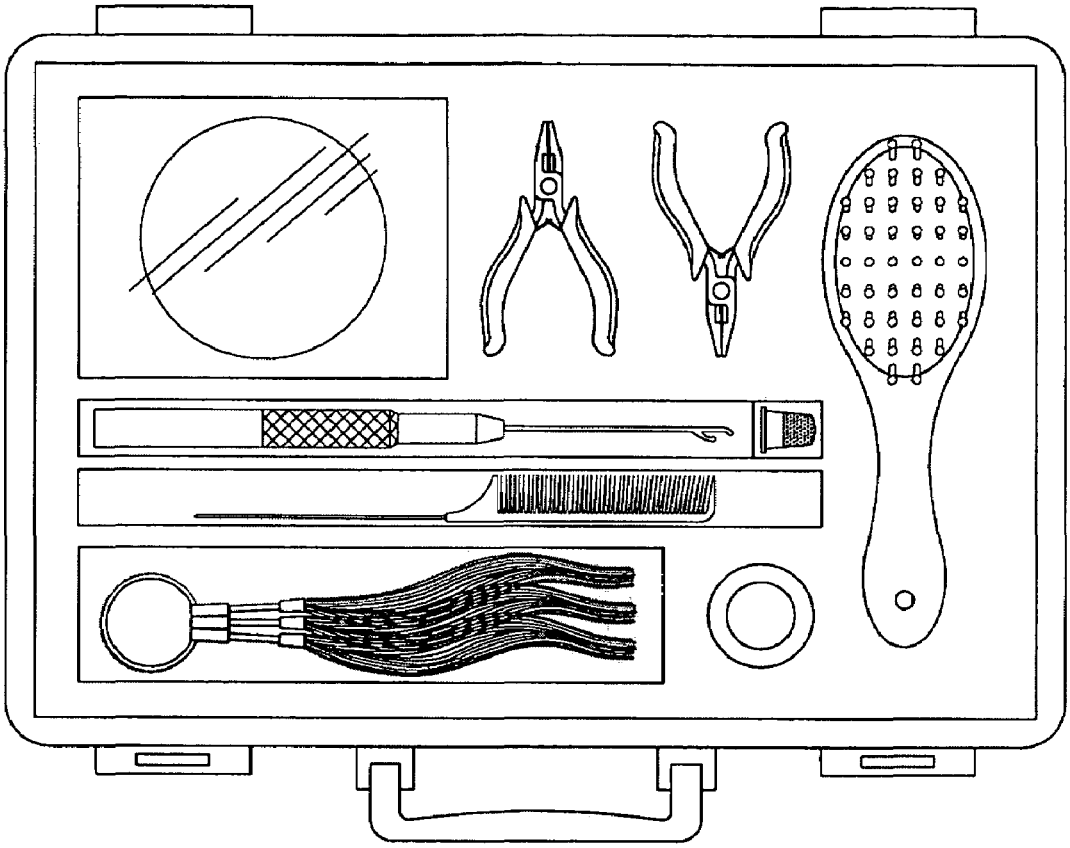
FIG. 11 is a perspective view of an exemplary embodiment of a hair extension kit of the present invention.
Figure 12:
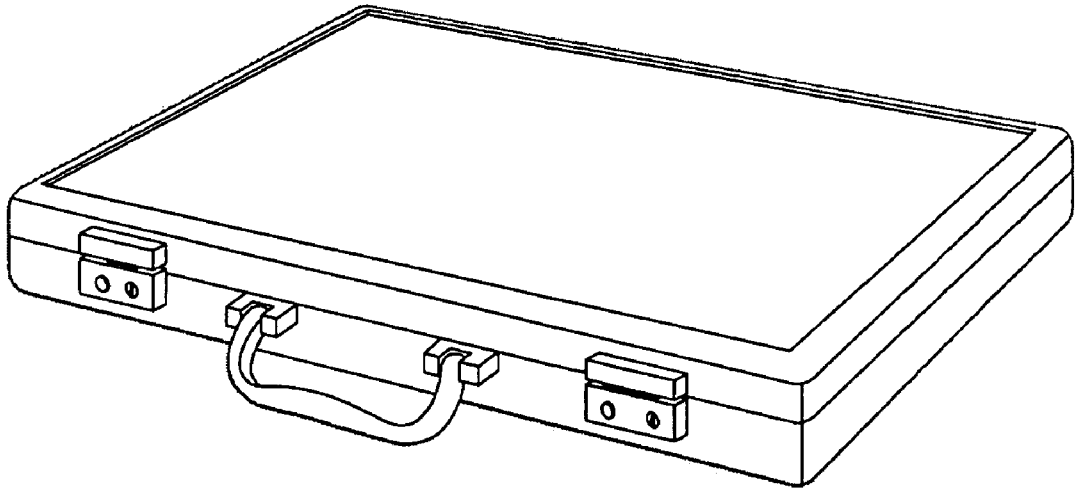
FIG. 12 is a perspective view of an exemplary container that can be incorporated into the hair extension kit shown in FIG. 11.
Figure 13:
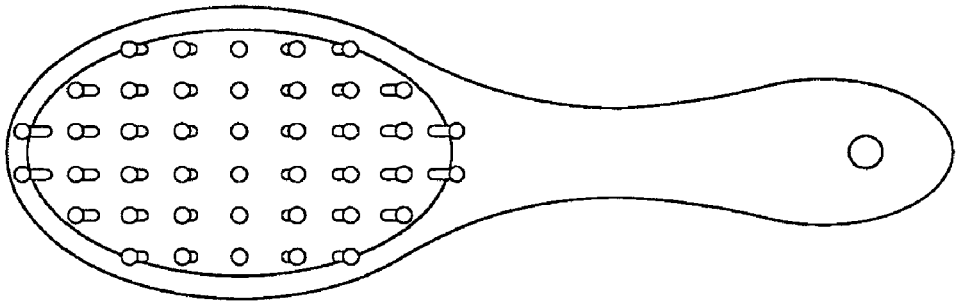
FIG. 13 is a perspective view of an exemplary brush that can be incorporated into the hair extension kit shown in FIG. 11.
Figure 14:
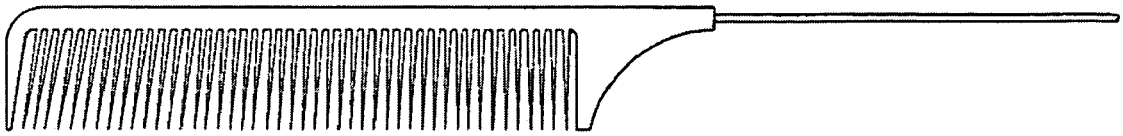
FIG. 14 is a perspective view of an exemplary comb that can be incorporated into the hair extension kit shown in FIG. 11.
Figure 15:
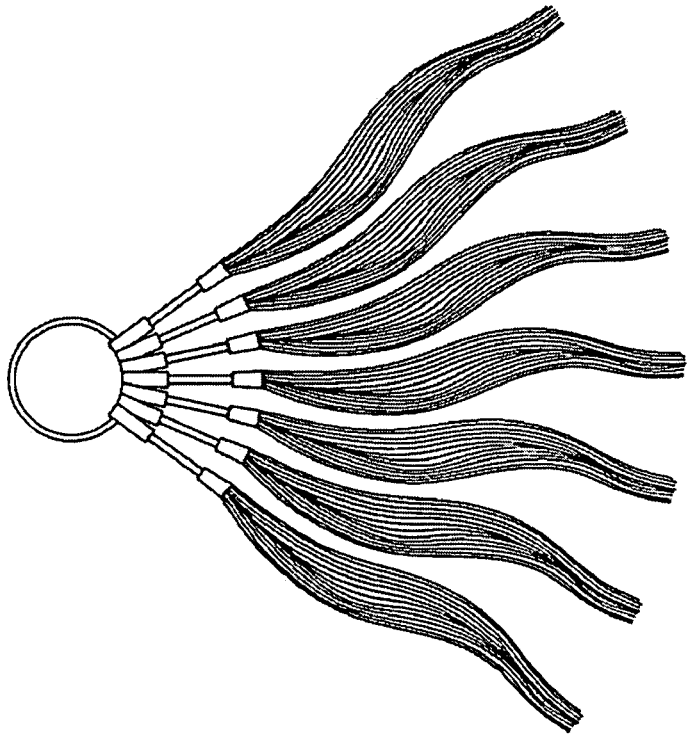
FIG. 15 is a perspective view of exemplary hair swatches that can be incorporated into the hair extension kit shown in FIG. 11.
Figure 16:
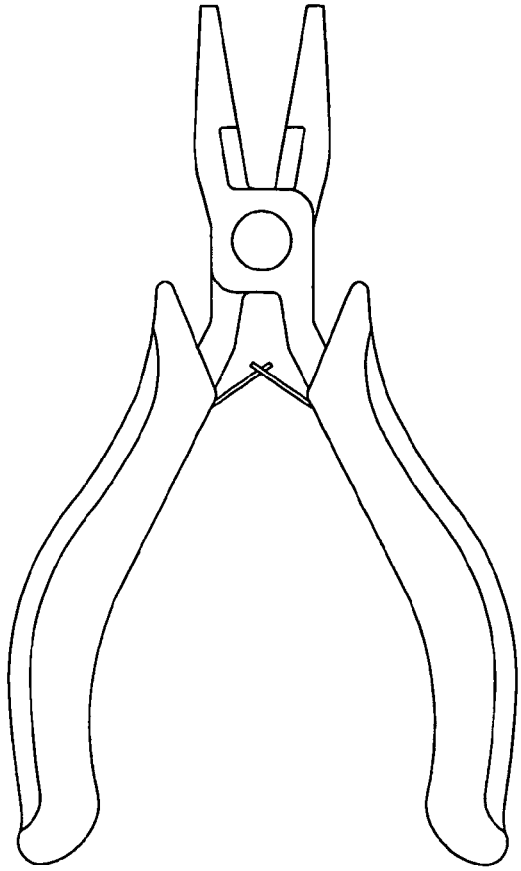
FIG. 16 is a perspective view of an exemplary plier that can be incorporated into the hair extension kit shown in FIG. 11.
Figure 17:
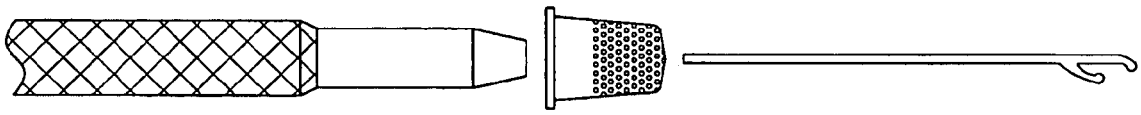
FIG. 17 is a perspective view of an exemplary hook needle and holder that can be incorporated into the hair extension kit shown in FIG. 11.

The anchor band can be in any suitable sizes. Referring to FIG. 8, the anchor band preferably has a length in the range of about 1 inch to about 15 inches and a width in the range of about ¼ inch to about 3 inches. The anchor band can be in any art-disclosed shapes, including but is not limited to, the ones shown in FIGS. 7-9. Furthermore, the anchor band may further comprise at least one slit as shown in FIG. 10. The slit allows additional primary hairs 5 to be pulled through the anchor band 10 providing better comfort to the user and prevents tangling and/or knotting of the primary hairs 5 while the user is wearing the hair extension apparatus 100.

In one preferred embodiment, the supplemental hairs 20 attached using flat knots to the anchor band 10 are evenly distributed within the anchor band 10 allowing a user to modify the size of the hair extension apparatus 100 to his or her desired reduced size or sizes by simply cutting or dividing the original hair extension apparatus 100.

Referring to FIG. 5, an attachment means 30 (shown herein as tubular ferrules) are engaged with the portion of the primary hairs 5 which are extended out of the mounting holes 16 and are used to secure the apparatus 100 to the user's scalp 7. The attachment means 30 are usually place adjacent to the frontal outer surface 14 of the anchor band as shown in FIGS. 4-5. It is preferred that the attachment means 30 receive primary hairs 5 from at least two of the mounting holes 16, and more preferably, the attachment means 30 receive the primary hairs 5 from only two of adjacent mounting holes 16 as shown in FIG. 5. It is also preferred that the mounting holes 16 are arranged in a linear array across the anchor band 10 as shown in FIGS. 3-5 and this linear array preferably comprises two or more parallel rows. The number of mounting holes in a linear array is depend on the desired length of the anchor band 10.

Figure 18:
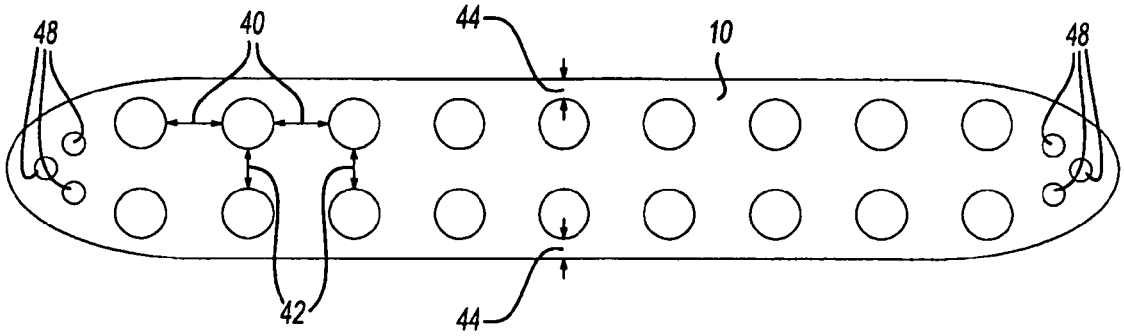
FIG. 18 is a perspective view of an exemplary embodiment of the anchor band of the present invention.

Referring to FIG. 18, the area 40 between adjacent mounting holes 16 (e.g., left and right) in a linear array measuring from center to center of each of the mounting holes 16 is preferably about 7 mm to about 16 mm, more preferably about 10 mm to about 14 mm, and most preferably about 12 mm to about 13 mm. Please note that FIG. 18 and all other drawings described herein are not drawn to scale. The area 42 between two linear arrays of mounting holes 16 (e.g., up and down) measuring from center to center of each of the mounting holes 16 is preferably about 10 mm to 25 mm, more preferably about 15 mm to about 20 mm, and most preferably about 17 mm to about 18 mm. It is preferred that the area 44 between the linear array of mounting holes 16 closest to the top or bottom edge of the anchor band 10 is about 4 mm to about 9 mm, preferably about 5 mm to 7 mm measuring from center of each of the mounting hole 16 in the linear array. It is preferred that all of the mounting holes 16 are spaced about 20 mm to 25 mm apart, more preferably about 10 mm to 20 mm apart, even more preferably about 12 mm to 17.50 mm apart (measuring from center to center of each of the mounting holes 16).

The mounting holes 16 can be any size(s) suitable for the desired application. It is preferred that the mounting holes 16 have a diameter of about 1 mm to about 4 mm, more preferably about 1.5 mm to about 3 mm. In an effort to prevent curling, or lifting of the anchor band 10 at tension points of the scalp 7, at least one side mounting hole 48 is optionally provided on each of the side edges of the anchor band 10. In FIG. 18, three side mounting holes 48 are provided on each side edge of the anchor band 10. The side mounting holes 48 can be any suitable size, but is preferably smaller in diameter than the mounting holes 16.

As discussed above, the mounting holes 16 is not limited to the periphery or side(s) of the anchor band 10; but instead, are placed through out the anchor band 10. The mounting holes 16 and the attachment means 30 are the only components of the hair extension apparatus 100 that are used in the attachment of the hair extension apparatus 100 to the scalp 7 and/or the primary hairs 5. Unlike conventional hair extension apparatus and certain hair replacement apparatus, the present invention does not use any adhesive for such attachment. Without the need for adhesive, the hair extension apparatus 100 can be easily removed, re-used, and/or re-applied without causing any damage and/or cutting to the primary hairs 5.

In the case of using tubular ferrules as the attachment means 30, they are crushed so as to clamp the portion of the primary hairs 5 for immobilizing the anchor band 10 against the scalp 7 as shown in FIG. 5. The tubular ferrules shown in the FIG. 5 is a preferred embodiment of the attachment means 30. However, the attachment means 30 for securing the primary hairs 5 can be accomplished by any suitable art-disclosed means. For instance, the attachment means 30 may be a simple length of metal that is bent into a V-shape and then closed about the primary hairs 5. Other examples of the attachment means 30 are knotting, crocheting, braiding and/or sewing the primary hairs 5 together; clamps; wires; etc. Additional suitable attachment means 30 would be considered obvious to those of skill in the art. Furthermore, the attachment means 30 can optionally contains features that would prevent damage to the primary hairs 5 during application. For example, if tubular ferrules, metal, or other hard materials are used as the attachment means 30, they preferably are coated with suitable art-disclosed soft and/or flexible material(s) such as plastic, silicone, foam, other polymer, fabric or a combination thereof in order to avoid damage to the primary hairs 5.

The Hair Extension Method of Use

In the present invention, a method of attaching the above described hair extension apparatus to the existing primary hairs 5 is provided and it includes the step of: placing the anchor band 10 against a user's scalp 7. It is preferred that this placing step is performed after bulk of the primary hairs 5 have been folded up and away from the location of the anchor band 10. Some primary hairs 5 are located under the anchor band 10. The method further includes feeding a portion of the primary hairs 5 through mounting holes 16 in the anchor band 10. The portion of the primary hairs 5 extending from at least two of the mounting holes 16 are then attached together using the attachment means 30. For example, in case of the attachment means 30 are tubular ferrules, the primary hairs 5 extending from at least two of the mounting holes 16 are fed through at least one of the tubular ferrules (30) and clamping the primary hairs 5 within the tubular ferrules 30 by flattening them. It has been found to be advantageous to take primary hairs 5 from two adjacent of the mounting holes 16 for attachment. In this manner, it is found to provide tight attachment, easy clamping, strong support of the anchor band 10 without adhesives, waxes, or the like. In an effort to prevent curling, or lifting of the anchor band 10 at tension points of the scalp 7, the primary hairs 5 can also be fed through at least two side mounting holes 48.

The above-described method of the present invention may optionally further include taping at least a portion of the supplementary hairs 20 located below the placement of the anchor band 10 on the user's scalp 7. This taping step is preferably performed before the primary hairs 5 are fed through the at least two of the mounting holes 16. The taping step helps to visually detect the supplementary hairs 20 from the primary hairs 5 so as to prevent the supplementary hairs 20 from being fed through the at least two of the mounting holes 16.

The method further comprises the step of covering the anchor band 10 and at least a portion of the supplementary hairs 20 with a portion of the existing primary hairs 5 so as to prevent the supplementary hairs 20 from being detected visually as distinct from the primary hairs 5. The method preferably includes receiving the primary hairs 5 through the ferrules 30 each from two adjacent of the mounting holes 16 as shown in FIG. 5. Because the primary hairs continue to grow outwardly from the scalp 7, the anchor band 10 and its supplementary hairs 20 tend to move downwardly on the scalp 7 over time. Eventually, the anchor band 10 would be visible when it no longer is covered by the primary hairs 20. Thus the present method may optionally includes the steps of releasing the attachment means 30 (e.g., opening the tubular ferrules, clamps, or the like); moving the anchor band 10 more tightly against the scalp 7 thereby drawing the primary hairs 5 fed through the at least two mounting holes 16 outward; and then reattaching such primary hairs 5 with the attachment means 30. In this manner, the apparatus may be easily tightened in place as necessary to its continued use.

Method of Making Hair Extension

The present invention also provides a method of making the hair extension apparatus 100 comprising: providing an anchor band having a frontal outer surface, a rear inner surface and mounting holes for accepting a portion of primary hairs; attaching supplementary hairs to the anchor band so that the supplementary hairs are extended away from the frontal outer surface and draped downwardly. This method may optionally include providing attachment means 30 for attaching the portion of the primary hairs 5 extending from at least two of the mounting holes 16 together.

Hair Extension Kit

Referring to FIGS. 7 and 11-17, the present invention provides a hair extension kit comprising at least one of the hair extension apparatus 100; at least one art-disclosed item selected from the group consisting of pliers, combs, brushes, hook needles and holders, attachment means (e.g., tubular ferrules or the like), hair swatches, instructions for use, hair decorative accessories, and a combination thereof; and a container for holding the at least one hair extension apparatus and the at least one item. The instructions for use can be in any format such as written, audio (e.g., tape or CD), video (tape or DVD), or a combination thereof. The hair decorative accessories can be any suitable art-disclosed items such as natural or artificial flowers, beads, feathers, gem stones, pearls; combs, barrettes, etc.

Alternatively, the hair extension kit may comprise a plier, a comb, a hook needle and holder, instructions for use, hair swatches and at least one item selected from the group consisting of adhesive tapes, attachment means for hair extension apparatus, hair decorative accessories, and a combination thereof; and a container for holding said plier, said comb, said hook needle and holder, said instructions for use, said hair swatches and said at least one item. The at least one of the hair extension apparatus 100 for this alternative embodiment would be purchased separately.

CONCLUSION

The enablements described in detail above are considered novel over the prior art of record and are considered critical to the operation of at least one aspect of one best node embodiment of the instant invention and to the achievement of the above described objectives. The words used in this specification to describe the instant embodiments are to be understood not only in the sense of their commonly defined meanings, but to include by special definition in this specification; structure, material or acts beyond the scope of the commonly defined meanings. Thus if an element can be understood in the context of this specification as including more that one meaning, then its use must be understood as being genetic to all possible meanings supported by the specification and by the work or works describing the element.

The definitions of the words or elements of the embodiments of the herein described invention and its related embodiments not described are, therefore, defined in this specification to include not only the combination of element which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later know to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with the reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A method for attaching a hair extension apparatus to a user's primary hairs comprising:

Providing a hair extension apparatus comprising:

an elongated flexible material having:

(a) a length from about 1 inch to about 15 inches and a width from about ¼ inch to about 3 inches;

(b) a frontal outer surface and a rear inner surface;

(c) an array of mounting holes for accepting the primary hairs wherein (i) each of the mounting holes has a diameter of from about 1 mm to about 1.5 mm, (ii) the array has at least two horizontal rows of the mounting holes with the first horizontal row located within about 4 mm to about 9 mm from top vertical edge of the flexible material and the last horizontal row located within about 4 mm to about 9 mm from bottom vertical edge of the flexible material, and (iii) vertical distance between each of the horizontal rows is from about 10 mm to about 25 mm; and (d) a plurality of supplementary hairs permanently engaged with the flexible material and extending out of and away from said frontal outer surface so as to drape downwardly;

Placing a first portion of primary hairs located above desired location for placement of the flexible material up and away from the desired location;

Placing the flexible material against the user's scalp in the desired location having a second portion of primary hairs and that allows the flexible material to be hidden by the first portion of primary hairs and a third portion of primary hairs that is located around the flexible material;

Feeding some of the second portion of primary hairs through each of the mounting holes;

Feeding the primary hairs extending from at least two of the mounting holes together through a tubular ferrule; and Flattening each of the tubular ferrules thereby forming a secured attachment between the flexible material and the user's scalp via the primary hairs extending from at least two of the mounting holes.

2. The method of claim 1 wherein the hair extension apparatus further comprising at least one slit visible as horizontal cut(s) within the flexible material and the method further comprised of feeding another portion of the primary hairs through the at least one slit allowing additional primary hairs to be fed through the flexible material.

3. The method of claim 1 wherein the feeding the primary hairs extending from at least two of the mounting holes together through a tubular ferrule step is performed using two mounting holes that are located adjacent to each other in each of the at least two horizontal rows.

4. The method of claim 1 wherein (1) the hair extension apparatus further comprising at least one side mounting hole smaller in diameter than the mounting holes in the array and is located at each horizontal side edge of the flexible material; and (2) the method further comprising feeding some of the second portion of primary hairs through the at least one side mounting hole located at each horizontal side edge of the flexible material.

5. The method of claim 1 wherein before the feeding some of the second portion of primary hairs through each of the mounting holes step, the method further comprising taping at least a portion of the supplementary hairs located below the flexible material.

6. The method of claim 1 further comprising:

Opening each of the tubule ferrules;

Moving the flexible material more tightly against the user's scalp thereby drawing the primary hairs extending from the at least two of said mounting holes outward; and Attaching the primary hairs extending from at least two of said mounting holes together via another tubule ferrule thereby forming a secured attachment between the flexible material and the user's scalp via the primary hairs extending from at least two of the mounting holes.

7. The method of claim 1 wherein total number of the mounting holes within the flexible material is at least 26.

8. A method for attaching a hair extension apparatus to a user's primary hairs comprising:

Providing a hair extension apparatus comprising:

an elongated flexible material having:

(a) a length from about 1 inch to about 15 inches and a width from about ¼ inch to about 3 inches;

(b) a frontal outer surface and a rear inner surface;

(c) an array of at least 26 mounting holes for accepting the primary hairs wherein (i) the array has at least two horizontal rows of the mounting holes with the first horizontal row located within about 4 mm to about 9 mm from top vertical edge of the flexible material and the last horizontal row located within about 4 mm to about 9 mm from bottom vertical edge of the flexible material, and (ii) vertical distance between each of the horizontal rows is from about 10 mm to about 25 mm;

(d) a plurality of supplementary hairs permanently engaged via flat knots with the flexible material and extending out of and away from said frontal outer surface so as to drape downwardly; and (e) at least one slit visible as horizontal cut(s) within the flexible material;

Placing a first portion of primary hairs located above desired location for placement of the flexible material up and away from the desired location;

Placing the flexible material against the user's scalp in the desired location having a second portion of primary hairs and that allows the flexible material to be hidden by the first portion of primary hairs and a third portion of primary hairs that is located around the flexible material;

Feeding some of the second portion of primary hairs through each of the mounting holes and each of the at least one slit;

Feeding the primary hairs extending from at least two of the mounting holes together through a tubular ferrule;

Flattening each of the tubular ferrules thereby forming a secured attachment between the flexible material and the user's scalp via the primary hairs extending from at least two of the mounting holes.

* * * * *